US008791350B2

(12) United States Patent
Okazaki

(10) Patent No.: US 8,791,350 B2
(45) Date of Patent: Jul. 29, 2014

(54) ACCOMPANIMENT DATA GENERATING APPARATUS

(75) Inventor: Masatsugu Okazaki, Hamamatsu (JP)

(73) Assignee: Yamaha Corporation (JP)

( * ) Notice: Subject to any disclaimer, the term of this patent is extended or adjusted under 35 U.S.C. 154(b) by 151 days.

(21) Appl. No.: 13/600,494

(22) Filed: Aug. 31, 2012

(65) Prior Publication Data

US 2013/0047821 A1 Feb. 28, 2013

(30) Foreign Application Priority Data

Aug. 31, 2011 (JP) ..... 2011-188510

(51) Int. Cl.
*G10H 1/08* (2006.01)
*G10H 7/00* (2006.01)
*G10H 7/02* (2006.01)

(52) U.S. Cl.
USPC ..... 84/610; 84/604; 84/605; 84/612; 84/613; 84/634; 84/636; 84/650; 84/652; 84/666

(58) Field of Classification Search
CPC ..... G10H 1/0008; G10H 1/0025; G10H 1/36; G10H 1/38; G10H 1/40; G10H 1/41; G10H 1/42; G10H 1/365; G10H 1/368; G10H 7/00; G10H 2210/066; G10H 2210/091; G10H 2210/125; G10H 2210/145; G10H 2210/151; G10H 2210/576; G10H 2220/101; G10H 2220/111; G10H 2220/315; G10H 2230/015; G10H 2240/056; G10H 2240/061; G10H 2240/071; G10H 2240/075; G10H 2240/091; G10H 2240/145; G10H 2240/165; G10H 2240/241; G10H 2240/251; G10H 2240/271; G10H 2240/285
See application file for complete search history.

(56) References Cited

U.S. PATENT DOCUMENTS

| | | | | |
|---|---|---|---|---|
| 4,876,937 | A | 10/1989 | Suzuki | |
| 5,563,361 | A | 10/1996 | Kondo | |
| 6,169,240 | B1 | 1/2001 | Suzuki | |
| 6,740,804 | B2 * | 5/2004 | Shimizu et al. | 84/609 |
| 2002/0093841 | A1 | 7/2002 | Kitayama et al. | |

(Continued)

FOREIGN PATENT DOCUMENTS

| | | | |
|---|---|---|---|
| JP | 6348271 | A | 12/1994 |
| JP | 3397082 | B2 | 4/2003 |
| JP | 2007293373 | A | 11/2007 |

OTHER PUBLICATIONS

European Search Report issued in European counterpart application No. EP12182320.7, dated Dec. 21, 2012.

*Primary Examiner* — Marlon Fletcher
(74) *Attorney, Agent, or Firm* — Rossi, Kimms & McDowell LLP

(57) ABSTRACT

An accompaniment data generating apparatus has a phrase waveform data storing portion for storing sets of phrase waveform data each indicative of a phrase of accompaniment tones preformed at a reference tempo and each corresponding to a different reference note. The accompaniment data generating apparatus obtains a reproduction tempo, obtains the first reference note, selects a set of phrase waveform data corresponding to the second reference note whose tone pitch is different from a tone pitch of the first reference note, and reads out the selected phrase waveform data set at a speed by which the tone pitch of the second reference note of the selected phrase waveform data set agrees with the tone pitch of the first reference note of a case where a set of phrase waveform data corresponding to the first reference note is reproduced at the reference note.

11 Claims, 10 Drawing Sheets

(56) References Cited

U.S. PATENT DOCUMENTS

2002/0105359 A1* 8/2002 Shimizu et al. ..... 327/1
2012/0192701 A1* 8/2012 Watanabe et al. ..... 84/622
2012/0271847 A1* 10/2012 Watanabe et al. ..... 707/769
2012/0278358 A1* 11/2012 Watanabe et al. ..... 707/769
2013/0047821 A1* 2/2013 Okazaki ..... 84/605
2013/0305902 A1* 11/2013 Okazaki et al. ..... 84/604
2013/0305907 A1* 11/2013 Kakishita ..... 84/613

* cited by examiner

FIG.3

| time required for performance(%) | time required for reading(%) | number of shifted semitones |
|---|---|---|
| 68-73 | 71 | -6 |
| 74-77 | 75 | -5 |
| 78-81 | 79 | -4 |
| 82-86 | 84 | -3 |
| 87-91 | 89 | -2 |
| 92-97 | 94 | -1 |
| 98-103 | 100 | 0 |
| 104-108 | 106 | +1 |
| 109-115 | 112 | +2 |
| 116-122 | 119 | +3 |
| 123-129 | 126 | +4 |
| 130-136 | 133 | +5 |
| 137-145 | 141 | +6 |

FIG.4

| time required for performance(%) | referential required time for performance(%) | number of shifted semitones | time required for reading(%) | adjusted time(%) (initial value) |
|---|---|---|---|---|
| 68-73 | 71 | -3 | 84 | 84 |
| 74-77 | 75 | -3 | 84 | 89 |
| 78-81 | 79 | -2 | 89 | 89 |
| 82-86 | 84 | -2 | 89 | 94 |
| 87-91 | 89 | -1 | 94 | 94 |
| 92-97 | 94 | -1 | 94 | 100 |
| 98-103 | 100 | 0 | 100 | 100 |
| 104-108 | 106 | +1 | 106 | 100 |
| 109-115 | 112 | +1 | 106 | 106 |
| 116-122 | 119 | +2 | 112 | 106 |
| 123-129 | 126 | +2 | 112 | 112 |
| 130-136 | 133 | +3 | 119 | 112 |
| 137-145 | 141 | +3 | 119 | 119 |

FIG.7

| performance speed(%) | reading speed (%) | number of shifted semitones |
|---|---|---|
| 68-73 | 71 | +6 |
| 74-77 | 75 | +5 |
| 78-81 | 79 | +4 |
| 82-86 | 84 | +3 |
| 87-91 | 89 | +2 |
| 92-97 | 94 | +1 |
| 98-103 | 100 | 0 |
| 104-108 | 106 | -1 |
| 109-115 | 112 | -2 |
| 116-122 | 119 | -3 |
| 123-129 | 126 | -4 |
| 130-136 | 133 | -5 |
| 137-145 | 141 | -6 |

FIG.8

| performance speed (%) | referential performance speed (%) | number of shifted semitones | reading speed (%) | adjusted speed (%) (initial value) |
|---|---|---|---|---|
| 68-73 | 71 | +3 | 84 | 84 |
| 74-77 | 75 | +3 | 84 | 89 |
| 78-81 | 79 | +2 | 89 | 89 |
| 82-86 | 84 | +2 | 89 | 94 |
| 87-91 | 89 | +1 | 94 | 94 |
| 92-97 | 94 | +1 | 94 | 100 |
| 98-103 | 100 | 0 | 100 | 100 |
| 104-108 | 106 | -1 | 106 | 100 |
| 109-115 | 112 | -1 | 106 | 106 |
| 116-122 | 119 | -2 | 112 | 106 |
| 123-129 | 126 | -2 | 112 | 112 |
| 130-136 | 133 | -3 | 119 | 112 |
| 137-145 | 141 | -3 | 119 | 119 |

ACCOMPANIMENT DATA GENERATING APPARATUS

BACKGROUND OF THE INVENTION

1. Field of the Invention

The present invention relates to an accompaniment data generating apparatus for generating accompaniment phrase waveform data.

2. Description of the Related Art

Conventionally, there is a known automatic accompaniment apparatus which stores sets of accompaniment style data based on automatic performance data such as MIDI format available in various music styles (genres), and adds accompaniment to user's musical performance in accordance with user's (performer's) selected accompaniment style data (see Japanese Patent Publication No. 2900753, for example).

The conventional accompaniment apparatus which uses automatic musical performance data converts tone pitches so that, for example, accompaniment style data based on a certain chord such as CMaj will match chord information detected from user's musical performance.

Furthermore, there is a known arpeggio performance apparatus which stores arpeggio pattern data as phrase waveform data, adjusts tone pitch and tempo to match user's input performance, and generates automatic accompaniment data (see Japanese Patent Publication No. 4274272, for example).

Furthermore, there is a known musical tone generating apparatus which separately performs the control of pitches of waveform data stored in a waveform memory and the control of reading of the waveform data such that the length on the time axis of a desired range of the waveform data will be stretched or shrunk (see Japanese Patent Publication No. 3397082). Such an apparatus is able not only to adjust pitches of the waveform data but also to adjust the length of the waveform data on the time axis by so-called time stretching.

SUMMARY OF THE INVENTION

Because the above-described automatic accompaniment apparatus which uses automatic performance data generates musical tones by use of MIDI or the like, it is difficult to perform automatic accompaniment in which musical tones of an ethnic musical instrument or a musical instrument using a peculiar scale are used. In addition, because the above-described automatic accompaniment apparatus offers accompaniment based on automatic performance data, it is difficult to exhibit realism of human live performance.

Furthermore, the conventional automatic accompaniment apparatus which uses phrase waveform data such as the above-described arpeggio performance apparatus is able to provide automatic performance of accompaniment phrases of monophony.

Furthermore, in a case where automatic performance data or automatic accompaniment data based on waveform data is used in synchronization with user's musical performance, the waveform data has to be adjusted in the time axis direction. However, if the length of the waveform data is adjusted in the time axis direction only by time stretching, deterioration of waveform concatenation will arise.

An object of the present invention is to reduce deterioration of sound quality produced when the performance tempo of phrase waveform data is changed.

In order to achieve the above-described object, it is a feature of the present invention to provide an accompaniment data generating apparatus including a phrase waveform data storing portion (8,15) for storing sets of phrase waveform data each indicative of a phrase of accompaniment tones performed at a reference tempo, and each corresponding to a different reference note; a reproduction tempo obtaining portion (SA2) for obtaining a reproduction tempo; a first reference note obtaining portion (SB2, SB3, SB5) for obtaining a first reference note; a selecting portion (SB5 to SB7, SB9, SB10, SB13, SB14) for selecting a set of phrase waveform data corresponding to a second reference note whose tone pitch is different from a tone pitch of the first reference note; and a reading portion (SB5 to SB7, SB11, SB12, SB16) for reading out the selected phrase waveform data set at a speed by which the tone pitch of the second reference note of the selected phrase waveform data set agrees with the tone pitch of the first reference note of a case where a set of phrase waveform data corresponding to the first reference note is reproduced at the reference tempo.

In this case, for example, the sets of phrase waveform data represent a plurality of accompaniment phrases corresponding to various chords corresponding to various roots; and the reference notes correspond to the various roots of the chords.

The selecting portion may calculate performance speed information relating to a ratio between the reference tempo and the reproduction tempo, and select a set of phrase waveform data corresponding to the second reference note in accordance with the calculated performance speed information. In this case, for example, the performance speed information is represented as a ratio between reading time or reading speed of the set of phrase waveform data of a case where the set of phrase waveform data is reproduced at the reference tempo and reading time or reading speed of the set of phrase waveform data of a case where the set of phrase waveform data is reproduced at the reproduction tempo.

Furthermore, the selecting portion may further have an interval obtaining portion (SB9) for obtaining an interval or a number of shifted semitones on the basis of a difference in tone pitch between the first reference note of the set of phrase waveform data and a note corresponding to the first reference note of the set of phrase waveform data of a case where the set of phrase waveform data is reproduced at the reproduction tempo; and the selecting portion may select a set of phrase waveform data corresponding to the second reference note which is different in tone pitch from the first reference note by the obtained interval or the number of shifted semitones. Furthermore, the selecting portion may have a table (FIG. 3, 4) which defines, as the number of shifted semitones or the interval, tone pitch difference information indicative of an amount of change in tone pitch of the reference note of a set of phrase waveform data of a case where a reproduction speed at which the set of phrase waveform data is reproduced is variously changed in a manner by which the tone pitch difference information is provided for respective ratios of various reproduction tempos to the reference tempo; and the selecting portion may obtain the tone pitch difference information corresponding to the calculated performance speed information by referencing to the table and select a set of phrase waveform data corresponding to the second reference note in accordance with the tone pitch difference information.

The table may further define not only the tone pitch difference information but also reading speed information relating to speed at which the set of phrase waveform data is read out in order to change the tone pitch of the reference note of the set of phrase waveform data by the amount of change in tone pitch of the reference note indicated by the tone pitch difference information in a manner by which the reading speed information is provided for respective ratios of the various reproduction tempos to the reference tempo; and by referencing to the table, the reading portion may read out a set of phrase waveform data corresponding to the second reference note in accordance with the reading speed information corresponding to the calculated performance speed information.

According to the present invention, furthermore, the reading portion may have a time stretching portion (SB12, SB16) for adjusting, when the set of phrase waveform data corresponding to the second reference note is read out, a length of the read set of phrase waveform data on a time axis by time-stretching. In this case, the adjustment of the length of the read phrase waveform data set on the time axis by the time stretching portion is done by eliminating a deviation of the length on the time axis of the read phrase waveform data set corresponding to the second reference note from the length on the time axis of the set of phrase waveform data which corresponds to the first reference note and is read out at the reproduction tempo.

The present invention is able to reduce deterioration of sound quality produced when the performance tempo of phrase waveform data is changed.

In carrying out the invention, the invention is not limited to the invention of the accompaniment data generating apparatus, but can be carried out as inventions of an accompaniment data generating method and a computer program for generating accompaniment data applied to an accompaniment data generating apparatus.

BRIEF DESCRIPTION OF THE DRAWINGS

FIG. 3 is a conceptual diagram indicative of an example table indicating a rule "A" for selecting waveform data in an automatic accompaniment data generating process according to the embodiment of the present invention;

FIG. 4 is a conceptual diagram indicative of an example table indicating a rule "B" for selecting waveform data in the automatic accompaniment data generating process according to the embodiment of the present invention;

FIG. 7 is a conceptual diagram indicative of a different example of the table indicating the rule "A" for selecting waveform data in the automatic accompaniment data generating process according to the embodiment of the present invention; and FIG. 8 is a conceptual diagram indicative of a different example of the table indicating the rule "B" for selecting waveform data in the automatic accompaniment data generating process according to the embodiment of the present invention.

DESCRIPTION OF THE PREFERRED EMBODIMENT

Figure 1:
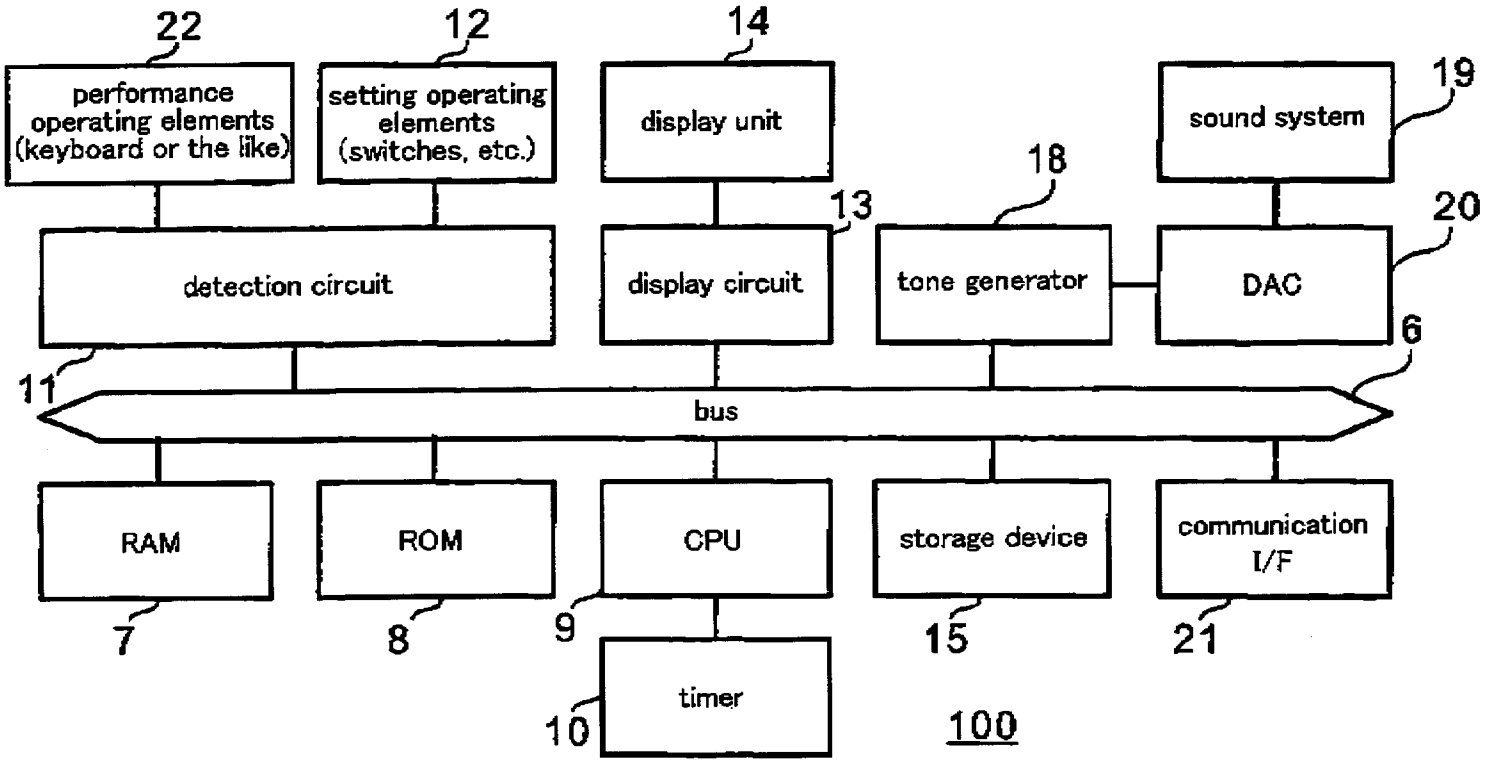
FIG. 1 is a block diagram indicative of an example hardware configuration of an accompaniment data generating apparatus according to an embodiment of the present invention.

FIG. 1 is a block diagram indicative of an example of a hardware configuration of an accompaniment data generating apparatus 100 according to the embodiment of the present invention.

A RAM 7, a ROM 8, a CPU 9, a detection circuit 11, a display circuit 13, a storage device 15, a waveform memory tone generator 18 and a communication interface (I/F) 21 are connected to a bus B of the accompaniment data generating apparatus 100.

The RAM 7 has buffer areas such as reproduction buffer and a working area provided for the CPU 9 in order to store flags, registers, various parameters and the like. For example, automatic accompaniment data which will be described later is to be loaded into a certain area of the RAM 7.

In the ROM 8, various kinds of data files (later-described automatic accompaniment data AA, for instance), various kinds of parameters, control programs, and programs for realizing the embodiment can be stored. In this case, there is no need to doubly store the programs and the like in the storage device 15.

The CPU 9 performs computations, and controls the apparatus in accordance with the control programs and programs for realizing the embodiment stored in the ROM 8 or the storage device 15. A timer 10 is connected to the CPU 9 to supply basic clock signals, interrupt timing and the like to the CPU 9.

A user uses setting operating elements 12 connected to the detection circuit 11 for various kinds of input, setting and selection. The setting operating elements 12 can be anything such as switch, pad, fader, slider, rotary encoder, joystick, jog shuttle, keyboard for inputting characters and mouse, as long as they are able to output signals corresponding to user's inputs. Furthermore, the setting operating elements 12 may be software switches which are displayed on a display unit 14 to be operated by use of operating elements such as cursor switches.

By using the setting operating elements 12, in this embodiment, the user selects automatic accompaniment data AA stored in the storage device 15, the ROM 8 or the like, or retrieved (downloaded) from an external apparatus through the communication I/F 21, instructs to start or stop automatic accompaniment, and makes various settings.

The display circuit 13 is connected to the display unit 14 to display various kinds of information on the display unit 14. The display unit 14 can display various kinds of information for the settings on the accompaniment data generating apparatus 100.

The storage device 15 is formed of at least one combination of a storage medium such as a hard disk, FD (flexible disk or floppy disk (trademark)), CD (compact disk), DVD (digital versatile disk), or semiconductor memory such as flash memory and its drive. The storage media can be either detachable or integrated into the accompaniment data generating apparatus 100. In the storage device 15 and (or) the ROM 8, preferably a plurality of automatic accompaniment data sets AA, and the programs for realizing the embodiment of the present invention and the other control programs can be stored. In a case where the programs for realizing the embodiment of the present invention and the other control programs are stored in the storage device 15, there is no need to store these programs in the ROM 8 as well. Furthermore, some of the programs can be stored in the storage device 15, with the other programs being stored in the ROM 8.

The tone generator 18 is a waveform memory tone generator, for example, which is a hardware or software tone generator that is capable of generating musical tone signals at least on the basis of waveform data (phrase waveform data). The tone generator 18 generates musical tone signals in accordance with automatic accompaniment data or automatic performance data stored in the storage device 15, the ROM 8, the RAM 7 or the like, or performance signals, MIDI signals, phrase waveform data or the like supplied from performance operating elements (keyboard) 22 or an external apparatus connected to the communication interface 21, adds various musical effects to the generated signals and supplies the signals to a sound system 19 through a DAC 20. The DAC 20 converts supplied digital musical tone signals into analog signals, while the sound system 19 which includes amplifiers and speakers emits the D/A converted musical tone signals as musical tones.

The communication interface 21, which is formed of at least one of a communication interface such as general-purpose wired short distance I/F such as USB and IEEE 1394, and a general-purpose network I/F such as Ethernet (trademark), a communication interface such as a general-purpose I/F such as MIDI I/F and a general-purpose short distance wireless I/F such as wireless LAN and Bluetooth (trademark), and a music-specific wireless communication interface, is capable of communicating with an external apparatus, a server and the like.

The performance operating elements (keyboard or the like) 22 are connected to the detection circuit 11 to supply performance information (performance data) in accordance with user's performance operation. The performance operating elements 22 are operating elements for inputting user's musical performance. More specifically, in response to user's operation of each performance operating element 22, a key-on signal or a key-off signal indicative of timing at which user's operation of the corresponding performance operating element 22 starts or finishes, respectively, and a tone pitch corresponding to the operated performance operating element 22 are input. By use of the musical performance operating element 22, in addition, various kinds of parameters such as a velocity value corresponding to the user's operation of the musical performance operating element 22 for musical performance can be input.

The musical performance information input by use of the musical performance operating elements (keyboard or the like) 22 includes chord information which will be described later or information for generating chord information. The chord information can be input not only by the musical performance operating elements (keyboard or the like) 22 but also by the setting operating elements 12 or an external apparatus connected to the communication interface 21.

Figure 2:
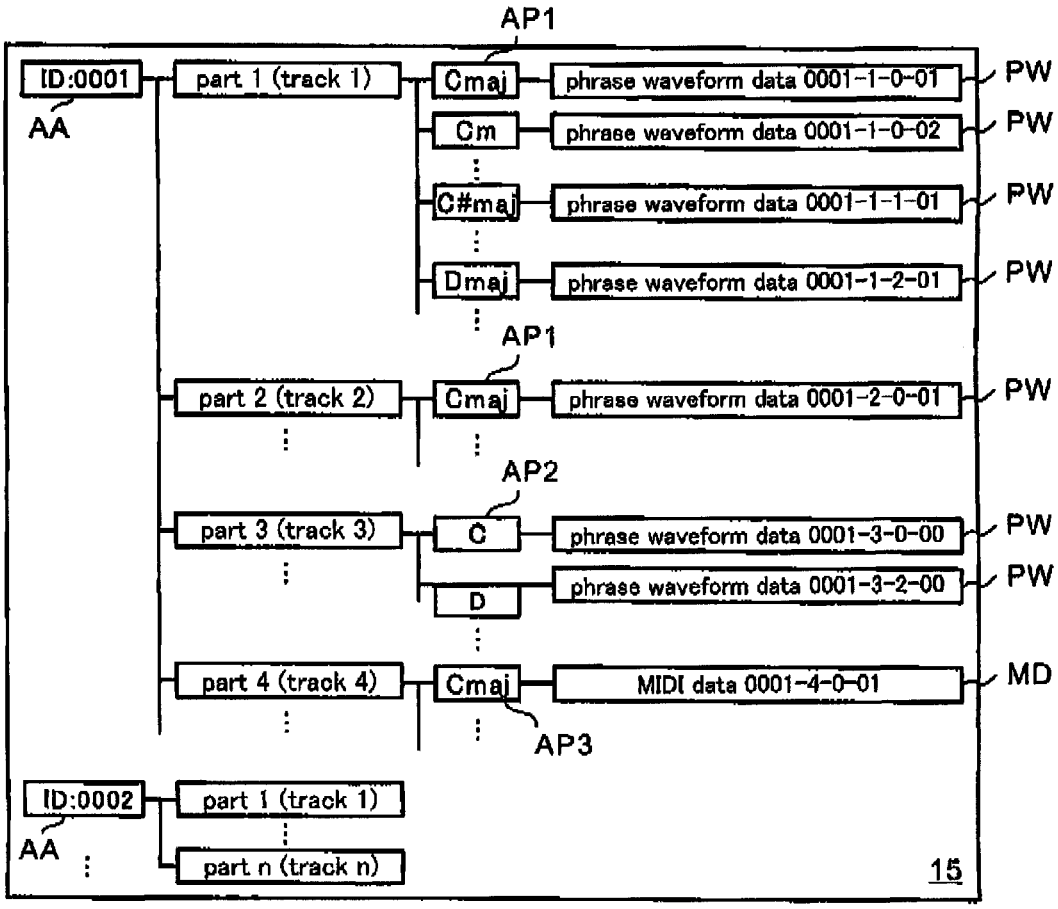
FIG. 2 is a conceptual diagram indicative of an example configuration of automatic accompaniment data used in the embodiment of the present invention.

FIG. 2 is a conceptual diagram indicative of an example configuration of the automatic accompaniment data AA used in the embodiment of the present invention.

In the embodiment of the present invention, automatic accompaniment which matches user's musical performance or automatic performance is performed by use of phrase waveform data PW or MIDI data MD included in the automatic accompaniment data AA indicated in FIG. 2, for example. In order to perform the automatic accompaniment, the phrase waveform data PW and the MIDI data MD have to be reproduced in accordance with a performance tempo (reproduction tempo). However, if time-stretching or the like is simply performed to change the length (reproduction tempo) of phrase waveform data PW on a time axis, waveform concatenation will be deteriorated. In order to reduce the deterioration of waveform concatenation, a later-described automatic accompaniment data generating process (FIG. 6A and FIG. 6B) is carried out in this embodiment to reproduce phrase waveform data PW at a desired reproduction tempo by combining time-stretching and changing of reading speed. In the case of MIDI data MD, however, the reproduction tempo will be changed by a known method, for changes in reproduction tempo will not cause deterioration of sound quality.

A set of automatic accompaniment data AA is formed of one or more accompaniment parts (tracks) each of which has at least one set of accompaniment pattern data AP. A set of automatic accompaniment data AA includes not only substantial data such as accompaniment pattern data AP but also setting information which is related to the entire automatic accompaniment data set and includes an accompaniment style name of the automatic accompaniment data set, time information, tempo information (tempo at which phrase waveform data PW is recorded (reproduced)) and information about respective accompaniment parts.

The automatic accompaniment data AA according to the embodiment of the invention is data for performing, when the user plays a melody line with the musical performance operating elements 22 indicated in FIG. 1, for example, automatic accompaniment of at least one part (track) in accordance with the melody line.

In this embodiment, sets of automatic accompaniment data AA are provided for each of various music genres such as jazz, rock and classic. The sets of automatic accompaniment data AA can be identified by identification number (ID number), accompaniment style name or the like. In this embodiment, sets of automatic accompaniment data AA are stored in the storage device 15 or the ROM 8 indicated in FIG. 1, for example, with each automatic accompaniment data set AA being given an ID number (e.g., "0001", "0002" or the like).

The automatic accompaniment data AA is generally provided for each accompaniment style classified according to rhythm type, musical genre, tempo and the like. Furthermore, each automatic accompaniment data set AA contains a plurality of sections provided for a song such as intro, main, fill-in and ending. Furthermore, each section is configured by a plurality of tracks such as chord track, base track and drum (rhythm) track. For convenience in explanation, however. It is assumed in this embodiment that the automatic accompaniment data set AA is configured by a certain section having a plurality of parts (part 1 (track 1) to part n (track n)) including at least a chord track for accompaniment which uses chords.

Each part of the parts 1 to n (tracks 1 to n) of the automatic accompaniment data set AA is correlated with any of accompaniment pattern data sets AP1 to AP3. The accompaniment pattern data AP1 supports plural chord types for each chord root (12 notes in total). Furthermore, each accompaniment pattern data set AP1 is correlated with one chord type with which at least a set of phrase waveform data PW is correlated. In this embodiment, for example, accompaniment pattern data AP1 supports various kinds of chord types such as major chord (Maj), minor chord (m) and seventh chord (7). For each chord type, more specifically, sets of accompaniment pattern data AP1 which respectively correspond to chord roots of 12 notes ranging from C to B are provided. Each of the parts 1 to n (tracks 1 to n) of the set of automatic accompaniment data AA stores sets of accompaniment pattern data AP1 respectively corresponding to the plural chord types for each chord root. Available chord types can be increased/decreased as desired. Furthermore, available chord types may be specified by a user. In the drum (rhythm) track, accompaniment pattern data AP2 which does not have any chord types is stored. Although the accompaniment pattern data AP2 is provided for respective tone pitches (12 notes) pitched in semitones, the accompaniment pattern data AP2 does not have any chord types to correspond, for any chords will not be used in this part.

In a case where a set of automatic accompaniment data AA has a plurality of parts (tracks), although at least one of the parts has to have accompaniment pattern data AP1 or AP2 with which phrase waveform data PW is correlated, the other parts may have accompaniment pattern data AP3 with which accompaniment phrase data based on automatic musical performance data such as MIDI is correlated. As in the case of a set of automatic accompaniment data AA having the ID number "0001" indicated in FIG. 2, for example, a set of automatic accompaniment data AA may be configured such that part 1 and part 2 have accompaniment pattern data AP1, part 3 has accompaniment pattern data AP2, and part 4 has accompaniment pattern data AP3 with which accompaniment phrase data based on MIDI data MD is correlated.

A set of phrase waveform data PW is phrase waveform data obtained by recording musical notes. The musical notes are produced by performance of an accompaniment phrase which is played at a certain tempo (recording tempo). The accompaniment phrase is based on a chord type and a chord root (reference note) which correspond to a set of accompaniment data AP correlated with the phrase waveform data set PW. The set of phrase waveform data PW has the length of one or more bars. The certain tempo (recording tempo) is equivalent to a reference tempo of the present invention, while a set of phrase waveform data represents a phrase of accompaniment notes played at the reference tempo. For instance, a set of phrase waveform data PW based on CMaj is waveform data in which musical notes (including accompaniment other than chord accompaniment) played mainly by use of tone pitches C, E and G which form the C major chord are digitally sampled and stored. Furthermore, there can be sets of phrase waveform data PW each of which includes tone pitches (which are not the chord notes) other than the notes which form the chord (the chord specified by a combination of a chord type and a chord root) on which the phrase waveform data set PW is based. In addition, although there can be sets of phrase waveform data PW each of which does not include its reference note but has tone pitches which are musically harmonious as accompaniment for musical performance based on the chord root and chord type specified by the chord information, such a phrase waveform data set PW is also considered to be correlated with the reference note. In this specification, more specifically, the "reference note" of a set of phrase waveform data PW (accompaniment pattern data AP) indicates the root of a chord included in chord progression for which the phrase waveform data set PW (accompaniment pattern data AP) should be used.

Furthermore, each set of phrase waveform data PW has an identifier by which the phrase waveform data set PW can be identified.

The sets of phrase waveform data PW may be generated on the basis of a recording tempo of one kind. Alternatively, the sets of phrase waveform data PW may be generated on the basis of tempos of plural kinds (for example, a recommended tempo of the automatic accompaniment data AA, and a tempo at which the phrase waveform data PW results in notes 5 semitones higher or lower). Furthermore, the value of the recording tempo may include a little error (dispersion) as long as a scale or reference of the recording tempo is understandable. The embodiment will be explained, assuming that each set of the phrase waveform data PW is recorded at a recording tempo 100 (in this embodiment, tempo is indicated by the number of quarter notes per minute).

In this embodiment, each set of phrase waveform data PW has an identifier having a form "ID (style number) of automatic accompaniment data AA—part(track) number—number indicative of a chord root—chord type number". In this embodiment, the identifiers are used as chord type information for identifying a chord type of a set of phrase waveform data PW and chord root information for Identifying a root (a chord root). By referring to the identifier of a set of phrase waveform data PW, therefore, a chord type and a chord root on which the phrase waveform data PW is based can be obtained. By employing a manner other than the above-described manner in which identifiers are used, information about chord type and chord root may be provided for each set of phrase waveform data PW. In a case where the recoding tempo varies among the sets of phrase waveform data PW, furthermore, each set of phrase waveform data PW is provided with information for identifying recording tempo.

MIDI data MD is formed of a set of tone pitch data indicative of respective tone pitches of accompaniment notes and timing data indicative of timing at which the respective notes are to be generated. As the tone pitch data, a key chord based on a certain chord such as CMaj is used, and the tone pitch data is generated as a source pattern with consideration given to conversion of tone pitch in accordance with the type and root of an input chord. When an automatic accompaniment is performed, therefore, tone pitches are converted in accordance with input chord information. For converting tone pitches of the source pattern generated on the basis of the certain chord to match the type of an input chord (chord information), shift data on key chords of source patterns is stored as a note conversion table in a manner in which the key chords are correlated with types of chords. As a result, shift data corresponding to the type of the input chord is read out from the note conversion table to compute the read shift data in accordance with the key chord of the source pattern to obtain an accompaniment pattern corresponding to the type of the chord.

Although this embodiment is designed such that each part has any of the accompaniment pattern data AP1 to AP3 each corresponding to a plurality of chord types, the embodiment may be modified such that each chord type has any of accompaniment pattern data AP1 to AP3 each corresponding to a plurality of parts.

Furthermore, the sets of phrase waveform data PW may be stored in the automatic accompaniment data AA. Alternatively, the sets of phrase waveform data PW may be stored separately from the automatic accompaniment data AA which stores only information indicative of links to the phrase waveform data sets PW.

In a case where the recording tempo of phrase waveform data PW is the same as the recommended tempo of the automatic accompaniment data AA, or in a case where the recording tempo of all the phrase waveform data sets PW is identical, the recording tempo can be stored as attribute information of the automatic accompaniment data AA as described above. In a case where different recording tempos are defined for the accompaniment pattern data AP1 and AP2, respectively, however, the recording tempos may be stored as attribute information of the respective accompaniment pattern data sets AP1 and AP2 or attribute information of each phrase waveform data set PW. In a case where sets of phrase waveform data PW are provided for an identical chord type having an identical chord root with different recording tempos, furthermore, the recording tempos are stored as attribute information of the accompaniment pattern data AP1 or AP2, or the respective sets of phrase waveform data PW.

FIG. 3 is a conceptual diagram indicative of an example table indicating a rule "A" for selecting waveform data in the automatic accompaniment data generating process according to the embodiment of the present invention. This table is provided, assuming that the recording tempo of each phrase waveform data set PW of FIG. 2 is "100".

In this embodiment of the present invention, the automatic accompaniment data AA including phrase waveform data PW recorded (generated) at a certain recording tempo ("100" in this embodiment) is reproduced at a certain performance tempo. For the reproduction of the automatic accompaniment data AA, a table indicated in FIG. 3 or FIG. 4 is referenced to select a set of phrase waveform data PW. This embodiment provides the first rule (rule "A") and the second rule (rule "B") as rules applied in order to select a set of phrase waveform data in a process for changing tempo of the selected phrase waveform data PW included in the automatic accompaniment data AA (for changing the length of the selected phrase waveform data PW on a time axis). The table indicated in FIG. 3 is a table used for the rule "A". A table used for the rule "B" is indicated in FIG. 4.

Time required for performance (%) is a ratio (%) of required time (per cycle, for example) of a case where a set of phrase waveform data PW is reproduced at the performance tempo (reproduction tempo) to referential required time. The referential required time is the required time (per cycle, for example) taken in a case where the set of phrase waveform data PW is reproduced at the recording tempo (reference tempo).

Time required for reading (%) is figured out on the basis of a ratio calculated in semitones. In a case where a set of phrase waveform data PW is read out in required time of 106% relative to the referential required time, for instance, tone pitches of the phrase waveform data set PW sound one semitone lower. In a case where the phrase waveform data set PW is read out in required time of 94%, tone pitches of the phrase waveform data set PW sound one semitone higher. The time required for reading (%) is a ratio to the referential required time which defines the speed at which the phrase waveform data set PW selected as accompaniment pattern data which is to be used is read out, and specifies the amount of pitch change. More specifically, the time required for reading (%) is a ratio to which reading speed will be changed in order to change the reference tone pitch of the accompaniment pattern data to the reference tone pitch specified by the chord information. The time required for reading is equivalent to reading speed information used in the present invention.

The number of shifted semitones represents, by the number of semitones, the difference in tone pitch (the amount of pitch-change) between the tone pitch of the phrase waveform data PW of a case where the phrase waveform data PW is read out in the time required for reading (%) and the tone pitch of the phrase waveform data PW of a case where the phrase waveform data PW is read out in the referential required time. The number of shifted semitones is equivalent to tone pitch difference information used in the present invention.

By the rule "A", the referential required time of the phrase waveform data PW which is to be reproduced is calculated first. Then, "required time for performance (%)" relative to the calculated referential required time is obtained. Furthermore, the table indicated in FIG. 3 is referenced to obtain the "number of shifted semitones" and the "required time for reading (%)" corresponding to the obtained "required time for performance (%)". The "required time for performance" is equivalent to performance speed information used in the present invention. Then, phrase waveform data PW having a reference tone pitch which is shifted by the "number of shifted semitones" from a reference tone pitch of the phrase waveform data PW which is to be reproduced is read out as the phrase waveform data PW which is to be used at the speed indicated by the "required time for reading (%)" to undergo a time stretch process to generate accompaniment data to output the generated accompaniment data.

Hereafter, a concrete example will be described. For convenience in explanation, the example will be described, assuming that it takes 10 seconds to reproduce the phrase waveform data PW at the recording tempo "100". In addition, the performance tempo is assumed to be set at "91".

In a case where "Em" is input as chord information, for example, a set of phrase waveform data PW having a chord root "E" and a chord type "m (minor)" is set as the current accompaniment pattern data. If the phrase waveform data PW (recording tempo "100" and referential required time of 10 seconds) is reproduced at performance tempo "91", the required time is 11.0 seconds, resulting in about 110%. Therefore, the "required time for performance (%)" of 110% is obtained. Referencing to the table indicated in FIG. 3 on the basis of the obtained "required time for performance (%)" of 110%, it can be understood that the "number of shifted semitones" is +2, and the "required time for reading" is 112%. Based on that the "number of shifted semitones" is "+2", therefore, a set of phrase waveform data PW which has a chord root "F#" which is 2 semitones higher than the chord root "E" and a chord type "m (minor)" is selected as accompaniment pattern data which is to be used, so that the selected phrase waveform data PW is read out at the speed of the "required time for reading (112%)" (that is, the selected phrase waveform data PW is read out in 11.2 seconds). As a result, the chord root of the phrase waveform data PW having the original chord root "F#" and the chord type "m (minor)" is pitch-changed to "E". Although the length of the phrase waveform data PW increases to 112% (11.2 seconds) of the original length (10 seconds) on the time axis, the set performance tempo is 110% (11.0 seconds) of the recording tempo. Therefore, the phrase waveform data PW further undergoes the time stretch process to reduce the length of the phrase waveform data PW on the time axis to 110% (reduction by approximately 1.79%, 0.2 second) to be output as accompaniment data.

If the phrase waveform data PW undergoes only the time stretch process to reproduce the phrase waveform data PW recorded at recording tempo "100" at performance tempo "91", the length of the phrase waveform data PW has to be stretched by 10% (in the above-described example, 1.0 second) on the time axis. In the case where the tempo is changed in accordance with the above-described rule "A", however, the reduction in the length of the phrase waveform data PW on the time axis is only approximately 1.79% (in the above-described example, 0.2 second), resulting in the reduction in influence caused by deterioration of waveform concatenation.

FIG. 4 is a conceptual diagram indicative of an example table indicating the rule "B" for selecting waveform data in the automatic accompaniment data generating process according to the embodiment of the present invention. This table is provided, assuming that the recording tempo of the phrase waveform data PW of FIG. 2 is "100".

The "required time for performance (%)", the "referential required time" and the "number of shifted semitones" are similar to those of the rule "A". However, the correspondence among the "required time for performance (%)", the "required time for reading (%)" and the "number of shifted semitones" is different from that of the rule "A".

Referential required time for performance (%) is provided for each certain range of required time for performance (%) to correspond to a tone pitch defined in semitones. More specifically, the referential required time for performance (%) indicates time required for performance (%) which can represent, as a difference measured in semitones, a difference between a tone pitch of the reference note of a case where the phrase waveform data PW is reproduced in the time required for performance (%) falling within the certain range at the recording tempo and a tone pitch of the reference note of a case where the phrase waveform data PW is reproduced in time obtained by multiplying the referential required time by referential required time for performance (%). In a case of the time required for performance of 68 to 73%, for example, the reference note of a case where the time required for performance is 71% sounds 6 semitones higher. In any cases of time required for performance of 68 to 73% other than 71%, however, the tone pitch cannot be represented as a difference measured in semitones. In the rule "B", furthermore, there is no correspondence between the number of shifted semitones and the referential required time for performance (%). For instance, reading of the phrase waveform data PW in the referential required time for performance (71%) results in a note which is 6 semitones higher than the original reference note. In a case where data is read out at this speed, therefore, the phrase waveform data PW having a reference note which is 6 semitones lower should be selected to be read out by the rule "A". In the rule "B", however, the number of shifted semitones of this case is defined as "−3", resulting in data which is 3 semitones lower being read out in the time required for reading (84%). In this case, the time required for reading is too long compared to the time required for performance. That is, the reproduction tempo is too slow for the set performance tempo. Therefore, the phrase waveform data PW is time-stretched by adjusted time (%) to accelerate the reproduction tempo in order to match the performance tempo.

The time required for reading (%) used in the rule "B" is a ratio to the referential required time which defines a speed at which the phrase waveform data PW selected as accompaniment pattern data which is to be used is read out, and specifies the amount of pitch change. By reading out the phrase waveform data PW selected as the accompaniment pattern data which is to be used at a reading speed defined by the "time required for reading (%)", the reference note of the phrase waveform data is to have a tone pitch which is the same tone pitch as the chord root indicated by the chord information. The description "the same tone pitch" used in this specification not only indicates complete agreement of the frequency between two notes but also includes variations as long as the two notes can be perceived as having the same tone pitch by human auditory perception.

The adjusted time (%) is a value for adjusting, after the reading of the phrase waveform data PW selected as accompaniment pattern data which is to be used at the speed indicated by the time required for reading (%), the length of the read phrase waveform data PW on the time axis to agree with the time required for performance. Values indicated in the table of FIG. 4 are initial values which will be increased or decreased in accordance with time required for performance. The adjusted time (%) is not a ratio to referential required time, but is represented as a ratio to "time required for reading (%)", so that the "time required for performance (%)" will be obtained by multiplying "time required for reading (%)" by "adjusted time (%)".

By the rule "B", the amount of pitch change is determined on the basis of the "number of shifted semitones" and the "time required for reading (%)", while the amount of time stretch is determined on the basis of the "adjusted time (%)". By adjusting the balance between the "number of shifted semitones" and the "time required for reading (%)", and the "adjusted time (%)", therefore, the balance between the amount of pitch change and the amount of time stretch can be adjusted. The embodiment may allow a user to adjust the balance.

Compared to the case of the rule "A" indicated in FIG. 3, the amount of pitch change is reduced in the rule "B" in order to reduce deterioration of format caused by pitch change. Therefore, the amount of time stretch increases. In the rule "A", each range of time required for performance has time required for reading which results in a semitone higher or lower than neighboring ranges, with the midpoint of the range of time required for performance being defined as time required for reading. In the rule "B", however, every two ranges of time required for performance has time required for reading which results in a semitone higher or lower. Therefore, the rule "B" requires a greater amount of time stretch than the rule "A".

By the rule "B", the referential required time of the phrase waveform data PW which is to be reproduced is calculated first. Then, "required time for performance (%)" relative to the calculated referential required time is obtained. Furthermore, the table indicated in FIG. 4 is referenced to obtain the "referential required time for performance (%)", the "number of shifted semitones", the "required time for reading (%)" and the "adjusted time (%)" corresponding to the obtained "required time for performance (%)". Then, the "adjusted time (%)" is increased or decreased in accordance with the difference between the "required time for performance" and the "referential required time for performance (%)". Then, the phrase waveform data PW shifted by the "number of shifted semitones" from the phrase waveform data PW which is to be reproduced is read out as the phrase waveform data PW which is to be used at the speed indicated by the "required time for reading (%)" to undergo the time stretch process in order to agree with the increased/decreased "adjusted time (%)" to generate accompaniment data to output the generated accompaniment data.

Hereafter, a concrete example will be described. For convenience in explanation, the example will be described, assuming that it takes 10 seconds to reproduce the phrase waveform data PW at recording tempo "100". In addition, the performance tempo is assumed to be set at "91".

In a case where "Em" is input as chord information, for example, a set of phrase waveform data PW having a chord root "E" and a chord type "m (minor)" is set as the current accompaniment pattern data. If the phrase waveform data PW (recording tempo "100" and referential required time of 10 seconds) is reproduced at performance tempo "91", the required time is 11 seconds, resulting in about 110%. Therefore, the "required time for performance (%)" of 110% is obtained. By referencing to the table indicated in FIG. 4 on the basis of the obtained "required time for performance (%)" of 110%, it can be understood that the "referential required time for performance" is 112%, the "number of shifted semitones" is +1, the "required time for reading" is 106%, and the "adjusted time" is 106%. Based on that the "number of shifted semitones" is "+1", therefore, a set of phrase waveform data PW which has a chord root "F" which is a semitone higher than the chord root "E" and a chord type "m (minor)" is selected as accompaniment pattern data which is to be used. Then, based on the difference (−2%) between the "time required for performance (110%)" and the "referential required time for performance (112%)", the "adjusted time (106%)" is increased or decreased to be the "adjusted time (104%)". Then, the phrase waveform data PW selected as accompaniment pattern data which is to be used is read out at the speed of the "required time for reading (106%)" (that is, the selected phrase waveform data PW is read out in 10.6 seconds). As a result, the chord root of the phrase waveform data PW having the original chord root "F" and the chord type "m (minor)" is pitch-changed to "E". Although the length of the phrase waveform data PW increases to 106% (10.6 seconds) of the original length (10 seconds) on the time axis, the set performance tempo is 110% (11 seconds) of the recording tempo. Therefore, the phrase waveform data PW further undergoes the time stretch process in order to agree with the "adjusted time (104%)" to further stretch the length of the phrase waveform data PW having the length of 106% on the time axis to 104% (stretch by 4%, 0.4 second) to be output as accompaniment data.

If the phrase waveform data PW undergoes only the time stretch process to reproduce the phrase waveform data PW recorded at the recording tempo "100" at the performance tempo "91", the length of the phrase waveform data PW has to be stretched by 10% (in the above-described example, 1.0 seconds) on the time axis. In the case where the tempo is changed in accordance with the above-described rule "B", however, the stretch in the length of the phrase waveform data PW on the time axis is only approximately 4% (in the above-described example, 0.4 second), resulting in the reduction in influence caused by deterioration of waveform concatenation. Furthermore, the rule "B" requires a greater amount of time stretch, compared with the rule "A". However, although the rule "A" requires the pitch change of 2 semitones, the rule "B" requires the pitch change of a semitone. Compared with the rule "A", therefore, the rule "B" causes deterioration of waveform concatenation, but reduces deterioration of format.

Figure 5A:
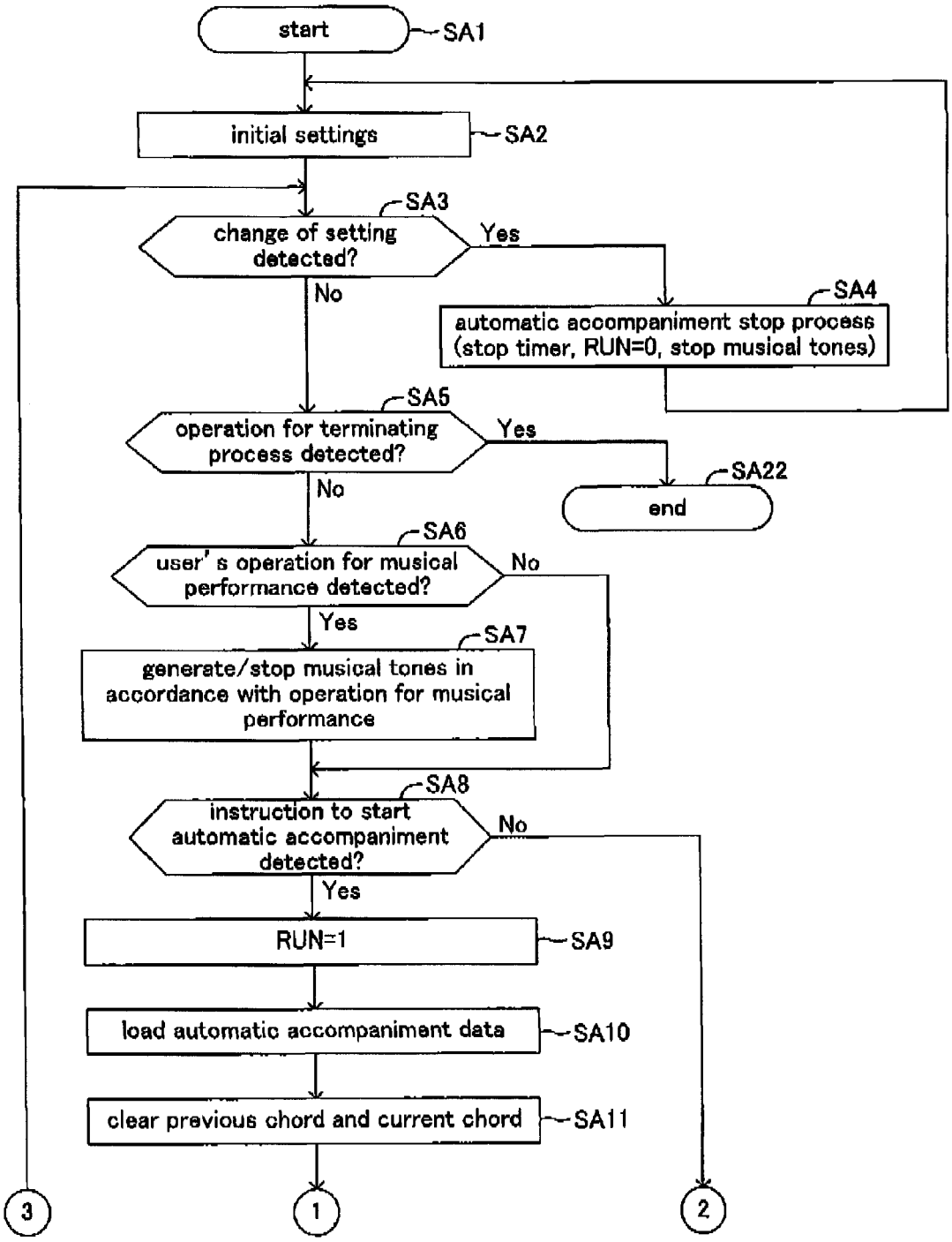
FIG. 5A is a flowchart of the first half of a main process according to the embodiment of the present invention.
Figure 5B:
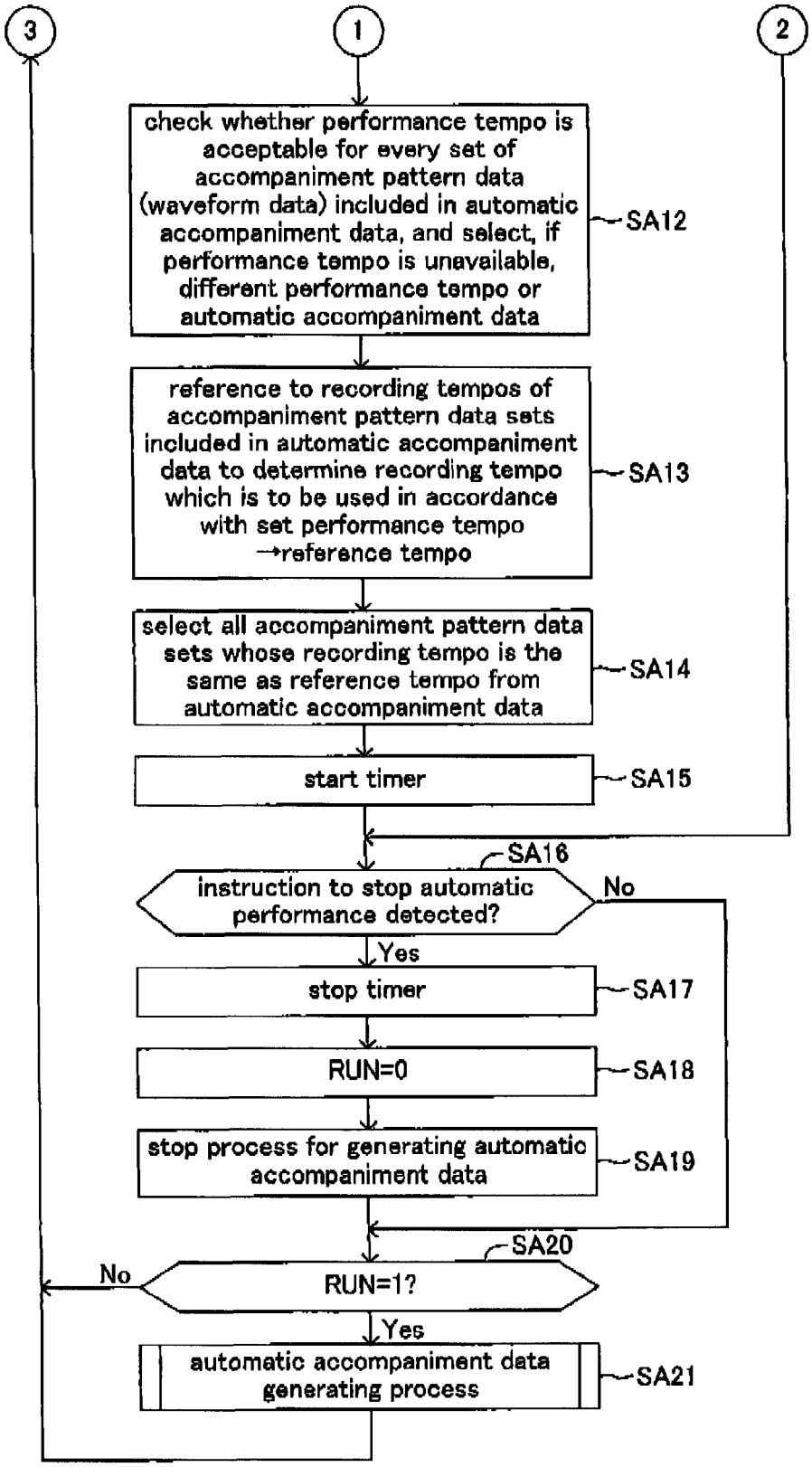
FIG. 5B is a flowchart of the latter half of the main process.

FIG. 5A and FIG. 5B are a flowchart of a main process of the embodiment of the present invention. This main process starts when power of the accompaniment data generating apparatus 100 according to the embodiment of the present invention is turned on.

At step SA1 indicated in FIG. 5A, the main process starts. At step SA2, initial settings are made. The initial settings include selection of automatic accompaniment data AA, specification of method of retrieving chord (input by user's musical performance, input by user's direct designation, automatic input based on chord progression information or the like), retrieval/specification of performance tempo, specification of key, and specification of rule for determining accompaniment pattern data which is to be used (rule "A" or rule "B"). The initial settings are made by use of the setting operating elements 12, for example, shown in FIG. 1. Furthermore, an automatic accompaniment process start flag RUN is initialized (RUN=0), and a timer, the other flags and registers are also initialized.

Although the performance (reproduction) tempo is set by the user at step SA2 when the user starts musical performance, the performance tempo may be changed during the musical performance. In this case, while the tempo is being changed in a state where the user is depressing a tempo adjustment switch, switching of accompaniment pattern data will not be performed. When a changed value of the tempo is determined, processing is performed to change the tempo to the newly set tempo.

At step SA3, it is determined whether user's operation for changing a setting has been detected or not. The operation for changing a setting indicates a change in a setting which requires initialization of current settings such as re-selection of automatic accompaniment data M. Therefore, the operation for changing a setting does not include a change in performance tempo, for example. When the operation for changing a setting has been detected, the process proceeds to step SA4 indicated by a "YES" arrow. When any operation for changing a setting has not been detected, the process proceeds to step SA5 indicated by a "NO" arrow.

At step SA4, an automatic accompaniment stop process is performed. The automatic accompaniment stop process stops the timer and sets the flag RUN at 0 (RUN=0), for example, to perform the process for stopping musical tones currently generated by automatic accompaniment. Then, the process returns to SA2 to make initial settings again in accordance with the detected operation for changing the setting. In a case where any automatic accompaniment is not being performed, the process directly returns to step SA2.

At step SA5, it is determined whether or not operation for terminating the main process (the power-down of the accompaniment generating apparatus 100) has been detected. When the operation for terminating the process has been detected, the process proceeds to step SA22 indicated by a "YES" arrow to terminate the main process. When the operation for terminating the process has not been detected, the process proceeds to step SA6 indicated by a "NO" arrow.

At step SA6, it is determined whether or not user's operation for musical performance has been detected. The detection of user's operation for musical performance is done by detecting whether any musical performance signals have been input by operation of the performance operating elements 22 shown in FIG. 1 or any musical performance signals have been input via the communication I/F 21. In a case where operation for musical performance has been detected, the process proceeds to step SA7 indicated by a "YES" arrow to perform a process for generating musical tones or a process for stopping musical tones in accordance with the detected operation for musical performance to proceed to step SA8. In a case where any musical performance operations have not been detected, the process proceeds to step SM indicated by a "NO" arrow.

At step SA8, it is determined whether or not an instruction to start automatic accompaniment has been detected. The instruction to start automatic accompaniment is made by user's operation of the setting operating element 12, for example, shown in FIG. 1. In a case where the instruction to start automatic accompaniment has been detected, the process proceeds to step SA9 indicated by a "YES" arrow. In a case where the instruction to start automatic accompaniment has not been detected, the process proceeds to step SA16 indicated by a "NO" arrow in FIG. 5B. The automatic accompaniment may be automatically started in response to the detection of start of user's musical performance.

At step SA9, the flag RUN is set at 1 (RUN=1). At step SA10, automatic accompaniment data AA selected at step SA2 or step SA3 is loaded from the storage device 15 or the like shown in FIG. 1 to a certain area of the RAM 7, for example. Then, at step SA11, the previous chord and the current chord are cleared, and the process proceeds to step SA12 shown in FIG. 5B.

At step SA12 of FIG. 5B, it is determined whether the performance tempo set at step SA2 is acceptable for each set of accompaniment pattern data AP (phrase waveform data PW) included in the automatic accompaniment data AA loaded at step SA10. In a case where it is determined that the set performance tempo is acceptable for every set of accompaniment pattern data AP, the process proceeds to the next step SA13. In a case where it is determined that the set performance tempo is not acceptable, the user is informed of the unavailability of the set performance tempo, and is prompted to set a performance tempo again or to select automatic accompaniment data AA again. In a case where a performance tempo is set again, or different automatic accompaniment data AA is selected, the process returns to step SA3 of FIG. 5A.

For the determination of whether the performance tempo is acceptable or not, the "time required for performance (%)" described with reference to FIG. 3 and FIG. 4 is figured out. In a case where the obtained "time required for performance (%)" is fallen within a range of 71% to 141%, that is, within a deviation of up to 6 semitones by human auditory perception, the performance tempo is judged to be acceptable. In the other cases, the performance tempo is judged to be unavailable. The range of the "time required for performance (%)" may be from 84% to 119% to be equivalent to a deviation of up to 3 semitones by human auditory perception. Alternatively, the range may be defined by the user as the user desires.

At step SA13, respective recording tempos of the sets of accompaniment pattern data AP (phrase waveform data PW) included in the automatic accompaniment data AA loaded at step SA10 are referenced to determine a recording tempo which is to be used in accordance with the performance tempo set at step SA2 to define the determined recording tempo as "reference tempo". In this step, a recording tempo of a set of accompaniment pattern data AP (phrase waveform data PW) whose "time required for performance (%)" calculated at step SA13 is the closest to 100% will be employed as the "reference tempo".

At step SA14, all the accompaniment pattern data sets AP (phrase waveform data sets PW) which are included in the automatic accompaniment data AA loaded at step SA10 and have a recording tempo which is the same as the "reference tempo" defined at step SA13 are selected as the sets of accompaniment pattern data AP (phrase waveform data PW) which are to be used at the later-described automatic accompaniment data generating process of step SA21. In a case where the area into which the automatic accompaniment data AA has been loaded at step SA10 is different from a working area for the automatic accompaniment data generating process, all the sets of accompaniment pattern data AP (phrase waveform data PW) selected at this step are loaded into the working area. Then, the timer is started at step SA15, and the process proceeds to step SA16.

At step SA16, it is determined whether or not an instruction to stop the automatic accompaniment has been detected. The instruction to stop automatic accompaniment is made by user's operation of the setting operating elements 12 shown in FIG. 1, for example. In a case where an instruction to stop the automatic accompaniment has been detected, the process proceeds to step SA17 indicated by a "YES" arrow. In a case an instruction to stop the automatic accompaniment has not been detected, the process proceeds to step SA20 indicated by a "NO" arrow. An automatic accompaniment may be automatically stopped in response to a detection of termination of user's musical performance.

At step SA17, the timer is stopped. At step SA18, the flag RUN is set at 0 (RUN=0). At step SA19, the process for generating automatic accompaniment data is stopped to proceed to step SA20. The stop of the process for generating automatic accompaniment data may be done immediately after the detection of an instruction to stop the process. Alternatively, the process may be stopped when the automatic accompaniment of currently reproduced accompaniment pattern data AP (phrase waveform data PW) has reached the end or a breakpoint (a point at which musical tones are broken, a border between bars, or the like) of the currently reproduced accompaniment pattern data AP (phrase waveform data PW).

At step SA20, it is determined whether the flag RUN is set at 1. In a case where the RUN is 1 (RUN=1), the process proceeds to step SA21 indicated by a "YES" arrow. In a case where the RUN is 0 (RUN=0), the process returns to step SA3 indicated by a "NO" arrow.

At step SA21, the process for generating automatic accompaniment data is performed. By the automatic accompaniment data generating process, in accordance with the set performance tempo, input chord information and the like, a set of phrase waveform data PW included in the automatic accompaniment data AA loaded at step SA10 is selected and adjusted (pitch-change, time stretch) to generate automatic accompaniment data. Details of the automatic accompaniment data generating process will be described later, referring to a flowchart of FIG. 6A and FIG. 6B. After the termination of the automatic accompaniment data generating process, the process returns to step SA3.

Figure 6A:
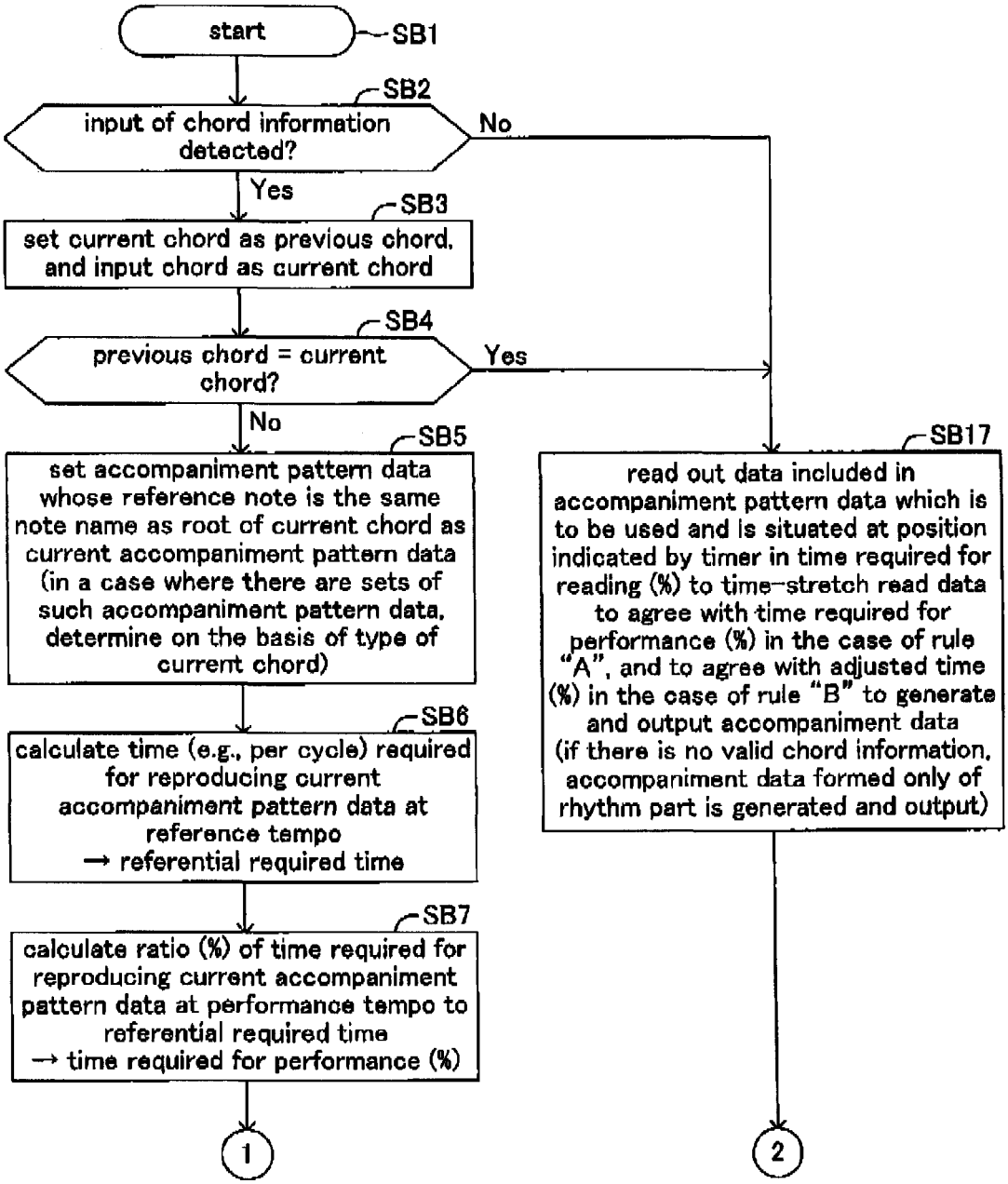
FIG. 6A is a flowchart of the first half of the automatic accompaniment data generating process performed at step SA21 of FIG. 5B.
Figure 6B:
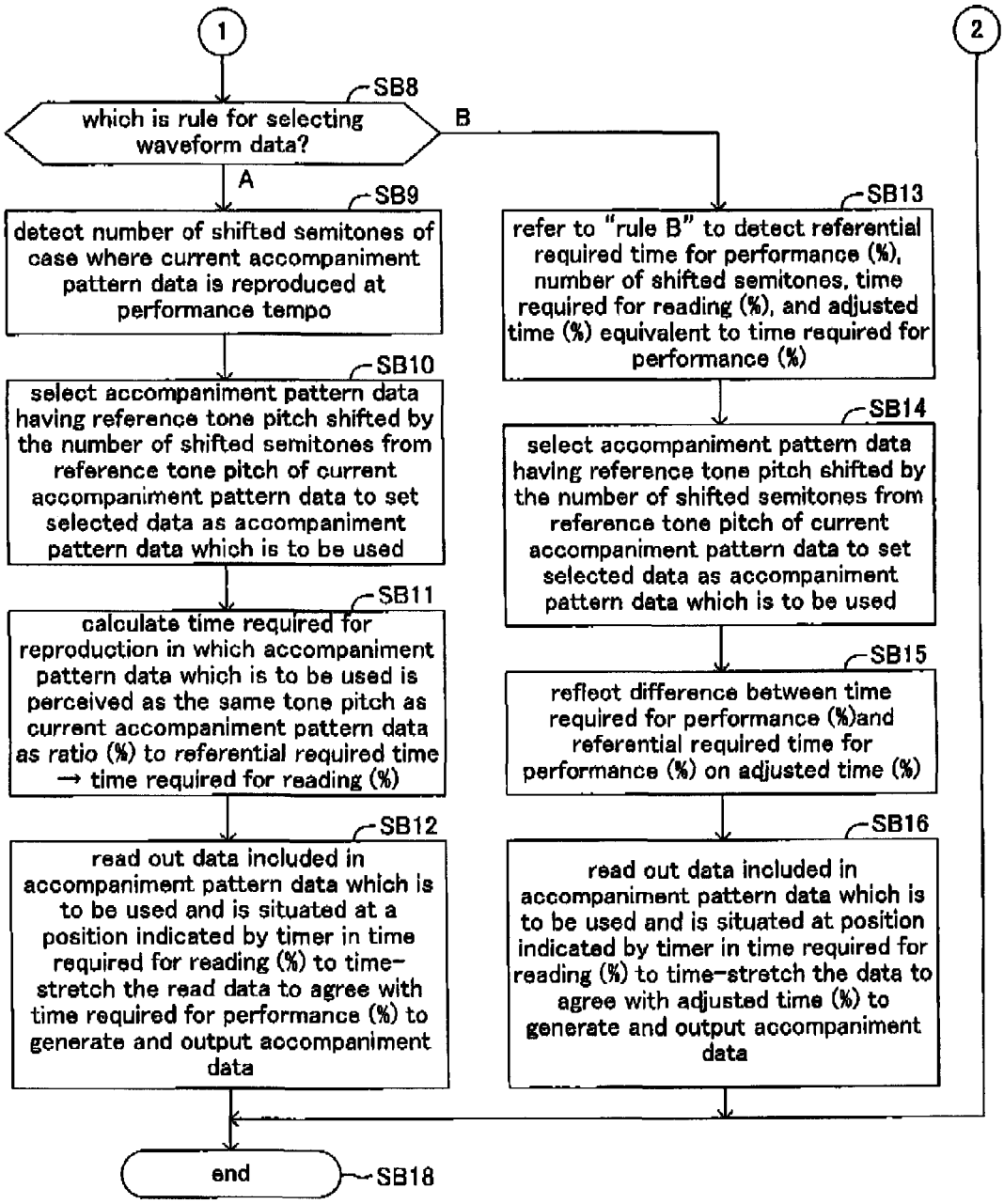
FIG. 6B is a flowchart of the latter half of the automatic accompaniment data generating process.

FIG. 6A and FIG. 6B are a flowchart indicative of the automatic accompaniment data generating process performed at step SA21 of FIG. 5B. In this example, a set of accompaniment pattern data which is to be used is determined on the basis of calculation in a case where the rule "A" (steps SB9 to SB12) has been selected, while a set of accompaniment pattern data which is to be used is determined by referencing to the table indicated in FIG. 4 in a case where the rule "B" (steps SB13 to SB16) has been selected. The determination of a set of accompaniment pattern data which is to be used is not limited to this example. Conversely to this example, a set of accompaniment pattern data which is to be used may be determined by referencing to the table indicated in FIG. 3 in the case of the rule "A", while a set of accompaniment pattern data which is to be used may be determined on the basis of calculation in the case of the rule "B". Furthermore, a set of accompaniment pattern data which is to be used may be determined on the basis of calculation in both cases of the rule "A" and the rule "B". Alternatively, a set of accompaniment pattern data may be determined in both cases by referencing to the tables of FIG. 3 and FIG. 4, respectively.

At step SB1 of FIG. 6A, the automatic accompaniment data generating process is started. At step SB2, it is determined whether input of chord information has been detected (whether chord information has been retrieved). In a case where input of chord information has been detected, the process proceeds to step SB3 indicated by a "YES" arrow. In a case where input of chord information has not been detected, the process proceeds to step SB17 indicated by a "NO" arrow.

The cases where input of chord information has not been detected include a case where automatic accompaniment is currently being generated on the basis of any chord information and a case where there is no valid chord information. In the case where there is no valid chord information, accompaniment data having only a rhythm part, for example, which does not require chord information may be generated. Alternatively, step SB2 may be repeated to wait for generating of accompaniment data without proceeding to step SB17 until valid chord information is input.

The input of chord information is done by user's musical performance using the musical performance operating elements 22 or the like indicated in FIG. 1. The retrieval of chord information based on user's musical performance may be detected from a combined key-depressions made in a chord key range which is a range included in the musical performance operating elements 22 of the keyboard or the like, for example (in this case, any musical notes will not be emitted in response to the key-depressions). Alternatively, the detection of chord information may be done on the basis of depressions of keys detected on the entire keyboard within a certain timing period. Furthermore, known chord detection arts may be employed. Furthermore, the input of chord information may not be limited to the musical performance operating elements 22 but may be done by the setting operating elements 12. In this case, chord information can be input as a combination of information (letter or numeric) indicative of a chord root and information (letter or numeric) indicative of a chord type. Alternatively, information indicative of an applicable chord may be input by use of a symbol or number. Furthermore, chord information may not be input by a user, but may be obtained by reading out a previously stored chord sequence (chord progression information) at a certain tempo, or by detecting chords from currently reproduced song data or the like.

At step SB3, the chord information specified as "current chord" is set as "previous chord", whereas the chord information detected (obtained) at step SB2 is set as "current chord".

At step SB4, it is determined whether the chord information set as "current chord" is the same as the chord information set as "previous chord". In a case where the two pieces of chord information are the same, the process proceeds to step SB17 indicated by a "YES" arrow. In a case where the two pieces of chord information are not the same, the process proceeds to step SB5 indicated by a "NO" arrow. At the first detection of chord information, the process proceeds to step SB5.

At step SB5, a set of accompaniment pattern data AP (phrase waveform data PW contained in the accompaniment pattern data AP) which is included in the sets of accompaniment pattern data AP selected (loaded) at step SA14, and has a reference tone pitch whose note name is the same as the chord root indicated by the chord information set as "current chord" is set as "current accompaniment pattern data". In a case where there are sets of applicable accompaniment pattern data AP (sets of phrase waveform data PW contained in accompaniment pattern data sets AP) (for example, a case where a plurality of chord types are provided), a set of accompaniment pattern data AP that matches the chord type indicated by the chord information set as "current chord" is set as "current accompaniment pattern data". In a case where there is no phrase waveform data PW that matches the chord type indicated by the chord information, the input chord information may be converted into a chord type of any of the provided phrase waveform data sets PW. In this case, it is preferable to previously provide a conversion rule for converting a chord type indicated by the input chord information into a chord type having as many constituent notes as possible which are the same as the constituent notes of the chord indicated by the input chord information.

At step SB6, time (per cycle, for example) required for reproducing the phrase waveform data PW set at step SIM as "current accompaniment pattern data" at the recording tempo (reference tempo) is calculated to set the calculated time as "referential required time".

At step SB7, a ratio (%) of the time (per cycle, for example) required for reproducing the phrase waveform data PW set at step SB5 as "current accompaniment pattern data" at the performance tempo (reproduction tempo) set at step SA2 of FIG. 5A to the "referential required time" set at step SB6 is calculated to set the obtained ratio as "time required for performance (%)".

At step SB8 of FIG. 6B, it is determined whether the rule for determining accompaniment pattern data set at step SA2, step SA3 or the like of FIG. 5A is "rule A" or "rule B". In a case where the rule for determining accompaniment pattern data is "rule A", the process proceeds to step SB9 indicated by an "A" arrow. In a case where the rule for determining accompaniment pattern data is "rule B", the process proceeds to step SB13 indicated by a "B" arrow.

At step SB9, the "number of shifted semitones" of a case where the phrase waveform data PW set as "current accompaniment pattern data" at step SB5 is reproduced at the performance tempo (reproduction tempo) set at step SA2 of FIG. 5A is detected. In a case, for example, time required for performance where phrase waveform data PW which has been recorded at "recording tempo (100)" and has a reference tone pitch of "C" is reproduced at "performance tempo (91)", the time required for performance is about 110%, with the "number of shifted semitones" being "+2".

At step SB10, a set of accompaniment pattern data AP (phrase waveform data PW) having a reference tone pitch shifted by the "number of shifted semitones" obtained at step SB9 from the reference tone pitch of the phrase waveform data PW set as "current accompaniment pattern data" at step S135 is selected from among the sets of accompaniment pattern data AP selected (or loaded) at step SA14 of FIG. 5B to set the selected set of accompaniment pattern data AP (phrase waveform data PW) as "accompaniment pattern data which is to be used". This embodiment is provided, assuming that 12 different sets (for 1 octave) of accompaniment pattern data AP (phrase waveform data PW) pitched in semitones are provided. In a case where accompaniment pattern data sets AP only for some of the note names included in an octave are provided, however, a set of accompaniment pattern data AP (phrase waveform data PW) having a reference tone pitch which is the closest to a reference tone pitch shifted by the "number of shifted semitones" is set as "accompaniment pattern data which is to be used".

At step SB11, the time required for reproduction (reading speed) in which the reference tone pitch of the set of accompaniment pattern data AP (phrase waveform data PW) set as "accompaniment pattern data which is to be used" at step SB10 is perceived as the same tone pitch as the reference tone pitch of the phrase waveform data PW set as "current accompaniment pattern data" at step SU is calculated as a ratio (%) to "referential required time" obtained at step SB6 to set the calculated ratio as "time required for reading (%)".

At step SB12, data which is included in the set of accompaniment pattern data AP (phrase waveform data PW) set as "accompaniment pattern data which is to be used" at step SB10 and is situated at a position indicated by the timer is read out in the "time required for reading (%)" set at step SB11 to undergo the time-stretch process to agree with the "time required for performance (%)" set at step SB7 to generate accompaniment data to output the generated accompaniment data. Then, the process proceeds to step SB18 to terminate the automatic accompaniment data generating process to return to step SA3 of FIG. 5A.

In a case where the table of FIG. 3 is referenced to determine a set of "accompaniment pattern data which is to be used" to generate accompaniment data instead of the steps SB9 to SB12, the "number of shifted semitones" and the "time required for reading (%)" are obtained from the table of FIG. 3 on the basis of the "time required for performance (%)" obtained at step SB7 instead of step SB9 and step SB11 to perform step SB10 on the basis of the obtained "number of shifted semitones" to determine a set of "accompaniment pattern data which is to be used". Then, step SB12 is performed.

At step SB13, the table of FIG. 4 is referenced to obtain "referential required time for performance (%)", "number of shifted semitones", "time required for reading (%)" and "adjusted time (%)" which are equivalent to the "time required for performance (%)" obtained at step SB7.

At step SB14, a set of accompaniment pattern data AP (phrase waveform data PW) having a reference tone pitch shifted by the "number of shifted semitones" detected at step SB13 from the reference tone pitch of the phrase waveform data PW set as "current accompaniment pattern data" at step SB5 is selected from among the sets of accompaniment pattern data AP selected (or loaded) at step SA14 of FIG. 5B to set the selected set of accompaniment pattern data AP (phrase waveform data PW) as "accompaniment pattern data which is to be used". In a case where accompaniment pattern data sets AP (phrase waveform data PW) only for some of the note names included in an octave are provided, a process similar to the above-described step SB10 is performed.

At step SB15, the difference between the "time required for performance (%)" obtained at step SB7 and the "referential required time for performance (%)" detected at step SB13 is reflected on the "adjusted time (%)". In a case of "time required for performance (109%)" and "referential required time for performance (112%)", for instance, the difference "3%" is added to "adjusted time (106%)" to obtain "adjusted time (109%)" (an initial value obtained by "time required for performance (%)"−"referential required time for performance (%)"+"adjusted time (%)").

At step SB16, data which is included in the set of accompaniment pattern data AP (phrase waveform data PW) set as "accompaniment pattern data which is to be used" at step SB14 and is situated at a position indicated by the timer is read out in the "time required for reading (%)" detected at step SB13 to undergo the time-stretch process to agree with the "adjusted time (%)" on which the difference has been reflected at step SB15 to generate accompaniment data to output the generated accompaniment data. Then, the process proceeds to step SB18 to terminate the automatic accompaniment data generating process to return to step SA3 of FIG. 5A.

At step SB17, data which is included in the accompaniment pattern data determined at step SB10 or step SB14 and is situated at a position indicated by the timer is read out, with the reading speed being adjusted so that the performance time (the length on the time axis) of the accompaniment pattern data which is to be used will be the "time required for reading (%)" obtained at step SB11 or the "time required for reading (%)" detected by referencing to the table at step SB13 ("referential required time" multiplied by "time required for reading (%)").

In a case where the rule "A" has been selected at step SA2 or SA3 of FIG. 5A as the rule for determining a set of accompaniment pattern data which is to be used, the read data is further undergo the time stretch process to agree with the "time required for performance (%)" obtained at step SB7 (so that the length of the processed data on the time axis will be "referential required time" multiplied by "time required for performance (%)") to generate accompaniment data to output the generated data.

In a case where the rule "B" has been selected at step SA2 or SA3 of FIG. 5A as the rule for determining a set of accompaniment pattern data which is to be used, the read data is further undergo the time stretch process to agree with the "adjusted time (%)" updated at step SB15 (so that the length of the processed data on the time axis will be "referential required time" multiplied by "time required for performance (%)" multiplied by "adjusted time (%)") to generate accompaniment data to output the generated data.

In a case where any valid chord information has not been set or input, only a rhythm part (e.g., accompaniment pattern data AP2 having phrase waveform data PW having no chord information indicated in FIG. 2) is processed in accordance with the rule "A" or rule "B" to output the processed data.

As for the accompaniment pattern data AP2 representative of a rhythm part or the like, irrespective of chord root specified by chord information, data whose pitch-changed tone pitch (read out in the reading time (%)) is a certain tone pitch (original tone pitch of a rhythm musical instrument) is read out in the reading time (%), and is time-stretched if necessary. This is because a tone pitch of a rhythm part is generally constant regardless of chord root.

Then, the process proceeds to step SB18 to terminate the automatic accompaniment data generating process to return to step SA3 of FIG. 5.

According to the above-described embodiment of the present invention, in a case where phrase waveform data corresponding to an accompaniment performed at a certain reference (recording) tempo is reproduced at a performance (reproduction) tempo which is different from the reference (recording) tempo, the accompaniment data generating apparatus for generating automatic accompaniment data which matches input chord information reads out, at the performance (reproduction) tempo or at a reading speed which is close to the performance tempo, not the phrase waveform data whose reference note agrees with the chord root indicated by the input chord information but the phrase waveform data whose reference note agrees with the chord root indicated by the input chord information when the phrase waveform data is reproduced at the performance (reproduction) tempo or at the reading speed which is close to the performance (reproduction) tempo.

According to the embodiment, furthermore, in a case where the agreement of the reference note with the chord root indicated by the chord information is achieved by reading out an appropriate set of phrase waveform data at the performance tempo, the automatic accompaniment generating apparatus performs only the pitch change process to change the tempo without the need for time-stretching, eliminating the deterioration of waveform concatenation caused by time-stretching.

In a case where the agreement of the reference note with the chord root indicated by the chord information is achieved by reading out a set of phrase waveform data not at the performance tempo but at a speed which is close to the performance tempo, the automatic accompaniment generating apparatus performs the pitch change process and the time stretch process in combination to change the tempo. In this case, although the time stretch process is necessary, the deterioration of waveform concatenation can be reduced, compared with a case where the tempo is changed only by the time stretch process. By adjusting the balance between the pitch change process and the time stretch process, furthermore, the balance between the deterioration of waveform concatenation caused by the time stretch process and the deterioration of format caused by the pitch change process can be adjusted.

According to the embodiment of the present invention, furthermore, because accompaniment patterns are provided as phrase waveform data, the automatic accompaniment generating apparatus achieves automatic accompaniment with high sound quality. Furthermore, the embodiment of the present invention enables automatic accompaniment by use of a peculiar musical instrument or by use of a peculiar scale whose tones are difficult to generate by a MIDI tone generator.

Although the present invention has been explained on the basis of the embodiment, the invention is not limited to the above-described embodiment. It is obvious for persons skilled in the art that the present invention can be variously modified, improved, and combined. Hereafter, modifications of the embodiment of the present invention will be described.

In the above-described embodiment, as indicated in the tables of FIG. 3 and FIG. 4, the difference between the recording tempo and the reproduction tempo of phrase waveform data is represented by a ratio of reproduction time. However, the difference between the recording tempo and the reproduction tempo may be represented by a ratio of performance speed (reproduction speed).

For instance, the time required for performance (%) and the time required for reading (%) indicated in FIG. 3 may be represented by performance speed (%) and reading speed (%), respectively, as indicated in FIG. 7. In this case, the performance speed (%) is a ratio (reproduction tempo/recording tempo) of reproduction tempo (reproduction speed at the reproduction tempo) to recording tempo (reproduction speed at the recording tempo), while the reading speed (%) is calculated on the basis of a ratio measured in semitones. If phrase waveform data PW is read out at a reproduction tempo of 106% with respect to recording tempo, for example, tone pitches of the phrase waveform data PW sound a semitone higher. If the phrase waveform data PW is read out at a reproduction tempo of 94%, the tone pitches sound a semitone lower.

Reading speed (%) is the ratio to referential required time which defines speed at which phrase waveform data PW selected as accompaniment pattern data which It to be used is read out, and defines the amount of pitch-change. In this case where the difference between the recording tempo and the reproduction tempo is represented by the ratio of speed, the arrangement of the number of shifted semitones indicated in the table of FIG. 3 is reversed with respect to the reading speed "100%". More specifically, as the reading speed (%) exceeding "100" increases more, a set of phrase waveform data PW having a lower reference tone pitch is selected. As the reading speed (%) falling below "100" decreases more, a set of phrase waveform data PW having a higher reference tone pitch is selected.

In the process indicated in FIG. 6A and FIG. 6B, furthermore, the time required for performance (%) and the time required for reading (%) are changed to performance speed (%) and reading speed (%), respectively, to reference to FIG. 7 to achieve the same effect. Furthermore, the referential required time can be changed to recording tempo.

Furthermore, the difference between the recording tempo and the reproduction tempo of the table of FIG. 4 can be similarly represented by the ratio of performance speed as indicated in FIG. 8. For instance, the time required for performance (%), the referential required time (%), the time required for reading (%), and the adjusted time (%) indicated in FIG. 4 can be represented by performance speed (%), reference speed (%), reading speed (%), and adjusted speed (%), respectively, as indicated in FIG. 8. In this case, the performance speed is equivalent to performance speed information of the present invention, while reading speed is equivalent to reading speed information of the invention.

The performance speed (%) is a ratio of reproduction tempo to recording tempo (reproduction tempo/recording tempo) as in the case of FIG. 7. The referential performance speed (%) is defined for every certain range of performance speed (%) to specify a tone pitch represented in semitones.

The reading speed (%) is a ratio to recording tempo. The reading speed (%) defines a reading speed at which the reference tone pitch of a set of phrase waveform data PW selected on the basis of the number of shifted semitones can be pitch-changed to the same tone pitch as the chord root indicated by chord information.

The adjusted speed (%) is a value for adjusting such that after the selected set of phrase waveform data PW has been read at the reading speed (%), the length of the read phrase waveform data PW on the time axis will agree with the time required for performance when played at the original recording tempo.

In the example shown in FIG. 8 as well, the arrangement of the number of shifted semitones indicated in the table of FIG. 4 is reversed with respect to the reading speed "100%". More specifically, as the reading speed (%) exceeding "100" increases more, a set of phrase waveform data PW having a lower reference tone pitch is selected. As the reading speed (%) falling below "100" decreases more, a set of phrase waveform data PW having a higher reference tone pitch is selected.

In the process indicated in FIG. 6A and FIG. 6B, furthermore, the time required for performance (%), the referential required time (%), the time required for reading (%), and the adjusted time (%) are changed to performance speed (%), reference speed (%), reading speed (%), and adjusted speed (%), respectively, to reference to FIG. 8 to achieve the same effect. Furthermore, the referential required time can be changed to recording tempo.

In the above-described embodiment, the difference in tone pitch is represented by use of the "number of shifted semitones". However, the difference in tone pitch may be represented by degree (interval). Alternatively, the difference in tone pitch may be represented by ratio of frequency or the like.

In the above-described embodiment, furthermore, one kind of the example table for selecting waveform data in the automatic accompaniment data generating process is provided for each of the rule "A" and the rule "B". However, plural kinds of tables may be provided for each rule so that the user can select one of them.

In the above-described embodiment, furthermore, sets of phrase waveform data PW corresponding to reference notes of 12 notes are provided for each part. However, reference notes of only a few kinds such as "C", "E" and "G#" may be provided for each part. In this case, a set of data corresponding to a reference note to which the "number of shifted semitones" is closest is selected as accompaniment pattern data which is to be used to adjust the amount of time stretch to agree with musical performance tempo.

Furthermore, the embodiment of the present invention is not limited to the form of an electronic musical instrument, but may be embodied by a commercially available computer or the like on which a computer program corresponding to the embodiment has been installed.

In this case, the computer program and the like corresponding to the embodiment may be provided for a user in a state where the computer program and the like are stored in a storage medium such as CD-ROM which a computer can read. In a case where the computer or the like is connected to a communication network such as LAN, Internet or telephone line, the computer program and various kinds of data may be provided for the user via the communication network.

What is claimed is:

1. An accompaniment data generating apparatus comprising:

a phrase waveform data storing portion for storing sets of phrase waveform data each indicative of a phrase of accompaniment tones performed at a reference tempo, and each corresponding to a different reference note;

a reproduction tempo obtaining portion for obtaining a reproduction tempo;

a first reference note obtaining portion for obtaining a first reference note;

a selecting portion for selecting a set of phrase waveform data corresponding to a second reference note whose tone pitch is different from a tone pitch of the first reference note; and a reading portion for reading out the selected phrase waveform data set at a speed by which the tone pitch of the second reference note of the selected phrase waveform data set agrees with the tone pitch of the first reference note of a case where a set of phrase waveform data corresponding to the first reference note is reproduced at the reference tempo.

2. The accompaniment data generating apparatus according to claim 1, wherein the sets of phrase waveform data represent a plurality of accompaniment phrases corresponding to various chords corresponding to various roots; and the reference notes correspond to the various roots of the chords.

3. The accompaniment data generating apparatus according to claim 1, wherein the selecting portion calculates performance speed information relating to a ratio between the reference tempo and the reproduction tempo, and selects a set of phrase waveform data corresponding to the second reference note in accordance with the calculated performance speed information.

4. The accompaniment data generating apparatus according to claim 3, wherein the selecting potion further has an interval obtaining portion for obtaining an interval or a number of shifted semitones on the basis of a difference in tone pitch between the first reference note of the set of phrase waveform data and a note corresponding to the first reference note of the set of phrase waveform data of a case where the set of phrase waveform data is reproduced at the reproduction tempo; and the selecting portion selects a set of phrase waveform data corresponding to the second reference note which is different in tone pitch from the first reference note by the obtained interval or the number of shifted semitones.

5. The accompaniment data generating apparatus according to claim 3, wherein the selecting portion has a table which defines, as the number of shifted semitones or the interval, tone pitch difference information indicative of an amount of change in tone pitch of the reference note of a set of phrase waveform data of a case where a reproduction speed at which the set of phrase waveform data is reproduced is variously changed in a manner by which the tone pitch difference information is provided for respective ratios of various reproduction tempos to the reference tempo; and the selecting portion obtains the tone pitch difference information corresponding to the calculated performance speed information by referencing to the table and selects a set of phrase waveform data corresponding to the second reference note in accordance with the tone pitch difference information.

6. The accompaniment data generating apparatus according to claim 5, wherein the table further defines not only the tone pitch difference information but also reading speed information relating to speed at which the set of phrase waveform data is read out in order to change the tone pitch of the reference note of the set of phrase waveform data by the amount of change in tone pitch of the reference note indicated by the tone pitch difference information in a manner by which the reading speed information is provided for respective ratios of the various reproduction tempos to the reference tempo; and by referencing to the table, the reading portion reads out a set of phrase waveform data corresponding to the second reference note in accordance with the reading speed information corresponding to the calculated performance speed information.

7. The accompaniment data generating apparatus according to claim 3, wherein the performance speed information is represented as a ratio between reading time or reading speed of the set of phrase waveform data of a case where the set of phrase waveform data is reproduced at the reference tempo and reading time or reading speed of the set of phrase waveform data of a case where the set of phrase waveform data is reproduced at the reproduction tempo.

8. The accompaniment data generating apparatus according to claim 1, wherein the reading portion has a time stretching portion for adjusting, when the set of phrase waveform data corresponding to the second reference note is read out, a length of the read set of phrase waveform data on a time axis by time-stretching.

9. The accompaniment data generating apparatus according to claim 8, wherein the adjustment of the length of the read phrase waveform data set on the time axis by the time stretching portion is done by eliminating a deviation of the length on the time axis of the read phrase waveform data set corresponding to the second reference note from the length on the time axis of the set of phrase waveform data which corresponds to the first reference note and is read out at the reproduction tempo.

10. An accompaniment data processing method applied to an accompaniment data generating apparatus having a phrase waveform data storing portion for storing sets of phrase waveform data each indicative of a phrase of accompaniment tones performed at a reference tempo, and each corresponding to a different reference note, the accompaniment data processing method comprising the steps of:

a reproduction tempo obtaining step of obtaining a reproduction tempo;

a first reference note obtaining step of obtaining a first reference note;

a selecting step of selecting a set of phrase waveform data corresponding to a second reference note whose tone pitch is different from a tone pitch of the first reference note; and a reading step of reading out the selected phrase waveform data set at a speed by which the tone pitch of the second reference note of the selected phrase waveform data set agrees with the tone pitch of the first reference note of a case where a set of phrase waveform data corresponding to the first reference note is reproduced at the reference tempo.

11. A storage medium storing a computer program that causes a computer to implement accompaniment data processing to be applied to an accompaniment data generating apparatus having a phrase waveform data storing portion for storing sets of phrase waveform data each indicative of a phrase of accompaniment tones performed at a reference tempo, and each corresponding to a different reference note, the computer program comprising the steps of:

a reproduction tempo obtaining step of obtaining a reproduction tempo;

a first reference note obtaining step of obtaining a first reference note;

a selecting step of selecting a set of phrase waveform data corresponding to a second reference note whose tone pitch is different from a tone pitch of the first reference note; and a reading step of reading out the selected phrase waveform data set at a speed by which the tone pitch of the second reference note of the selected phrase waveform data set agrees with the tone pitch of the first reference note of a case where a set of phrase waveform data corresponding to the first reference note is reproduced at the reference tempo.

* * * * *